US005414172A

United States Patent [19]

Chin et al.

[11] Patent Number: 5,414,172

[45] Date of Patent: May 9, 1995

[54] NAPHTHA UPGRADING

[75] Inventors: Arthur A. Chin, Cherry Hill; Nick A. Collins, Medford, both of N.J.; Mohsen N. Harandi, Longhorne, Pa.; Robert T. Thomson, Laurenceville, N.J.; Robert A. Ware, Wyndmoor, Pa.

[73] Assignee: Mobil Oil Corporation, Fairfax, Va.

[21] Appl. No.: 184,902

[22] Filed: Jan. 21, 1994

Related U.S. Application Data

[63] Continuation of Ser. No. 28,054, Mar. 8, 1993, abandoned.

[51] Int. Cl.[6] ..... C07C 2/66; C07C 4/06

[52] U.S. Cl. ..... 585/322; 585/312; 585/323; 585/324; 585/467; 585/800; 208/62; 208/92; 208/100

[58] Field of Search ..... 585/467, 323, 322, 648, 585/651, 653, 312, 324, 800; 208/62, 92, 100

[56] References Cited

U.S. PATENT DOCUMENTS

| | | | |
|---|---|---|---|
| 3,650,943 | 3/1972 | Schuller | 585/324 |
| 3,658,690 | 4/1972 | Graven | 208/62 |
| 3,770,614 | 11/1973 | Graven | 208/92 |
| 3,925,500 | 12/1975 | Wentzheimer | 585/324 |
| 4,090,949 | 5/1978 | Owen et al. | 208/78 |
| 4,746,762 | 5/1988 | Avidan et al. | 585/415 |
| 4,751,338 | 6/1988 | Tabak et al. | 585/415 |
| 4,753,720 | 6/1988 | Morrison | 208/135 |
| 4,778,661 | 10/1988 | Avidan et al. | 422/146 |
| 4,827,069 | 5/1989 | Kushnerick et al. | 585/415 |
| 4,855,521 | 8/1989 | Avidan et al. | 585/415 |
| 4,950,387 | 8/1990 | Harandi et al. | 208/49 |
| 4,975,179 | 11/1990 | Harandi et al. | 585/323 |
| 4,992,607 | 2/1991 | Harandi et al. | 585/467 |
| 5,185,486 | 2/1993 | Collin et al. | 585/467 |
| 5,210,348 | 5/1993 | Hsiea et al. | 585/323 |
| 5,227,555 | 7/1993 | Rhoe et al. | 585/467 |
| 5,347,061 | 9/1994 | Harandi et al. | 585/323 |

*Primary Examiner*—Anthony McFarlane

*Attorney, Agent, or Firm*—A. J. McKillop; M. D. Keen

[57] ABSTRACT

A process for upgrading low octane naphthas to produce gasoline products with low levels of benzene and aromatics while retaining a high pool octane uses a paraffinic naphtha reformer feed which is dehexanized to provide a $C_7+$ fraction which is fed to the reformer and a $C_6$ fraction which is fed together with the $C_6$ fraction from the reformer effluent to a catalytic upgrading step where the low octane components from the naphtha and the benzene from the reformate are converted to a low benzene, high octane gasoline by alkylation of the benzene and other aromatics present in the reformate. The process has the advantage that benzene make in the reformer is reduced by the partial by-passing of the $C_6$ benzene precursors around the reformer; in addition, improved benzene alkylation results from the presence of additional light olefins generated by the cracking of paraffins from the paraffinic naphtha. the reaction is preferably carried out in a turbulent fluidized bed reaction zone.

25 Claims, 1 Drawing Sheet

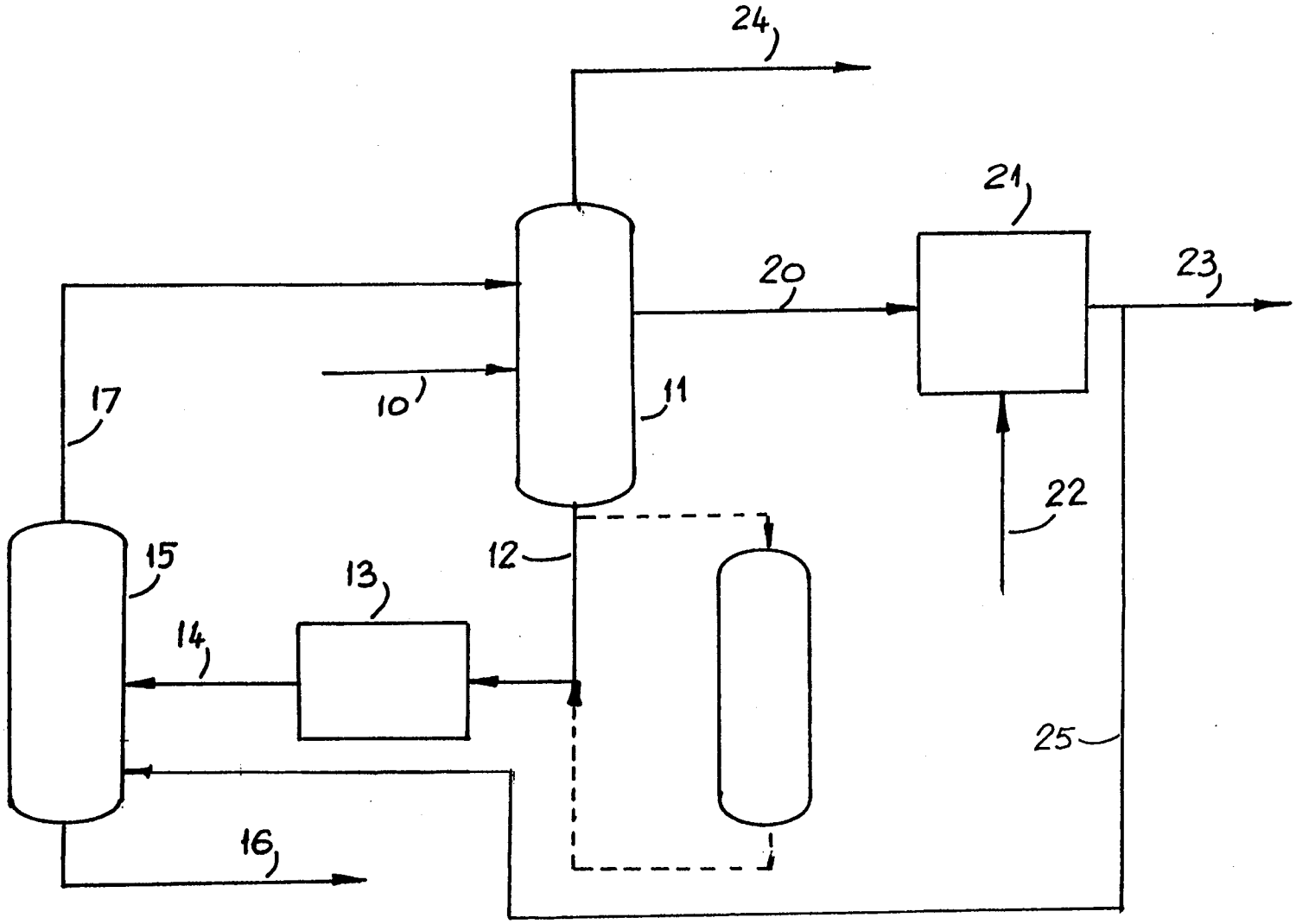
23
21
22
25
24
20
11
12
10
13
14
15
16
17

NAPHTHA UPGRADING

CROSS REFERENCE TO RELATED APPLICATIONS

This application is related to application Ser. No. 08/028,056, filed concurrently and now abandoned, to application Ser. No. 08/028,055, filed concurrently and now abandoned, and to application Ser. No. 08/028,057, filed concurrently, now U.S. Pat. No. 5,347,061. This application is also a continuation of Ser. No. 08/028,054, filed Mar. 8, 1993, now abandoned.

FIELD OF THE INVENTION

The present invention relates to a process for upgrading naphtha and of reducing the benzene content of reformate.

BACKGROUND OF THE INVENTION

The production of high octane gasoline continues to be a major objective of refinery operations worldwide. The phase-out of lead and the movement to reformulate gasoline to improve air quality in the United States, Europe, and the Pacific Rim countries present a major challenge in the refining industry. In the United States, the recent Clean Act Amendments define reformulated gasoline in terms of properties such as RVP (Reid Vapor Pressure) and composition including oxygen, benzene, and total aromatics contents, as well as in terms of performance, measured by reductions in volatile Organic Compounds (VOC) and gaseous toxic effluents. More stringent requirements may be required in the future as indicated by California Air Resources Board proposals for further limitations on gasoline olefins, sulfur, RVP, and distillation parameters.

In most of the regulatory schemes now under consideration, limitations will be placed on the permissible level of benzene in motor gasolines. Much of the benzene in motor gasoline comes from reformate which is a major high octane contributor and therefore desirable from this point of view. Given the need for high octane fuel in current engine designs, the requirement for reforming as a source of octane will continue but only if the benzene levels can be held at permissible levels.

U.S. Pat. No. 4,827,069 (Kushnerick) describes a process for alkylating the aromatic components in reformate with light olefins from FCC off gases, to produce high octane alkyl aromatics which are less toxic than benzene. The process is carried out by passing the reformate and the light olefin co-feed into a fluidized bed of catalyst, preferably ZSM-5, at a temperature which is typically in the range of 500° to 800° F. The ethylene and propylene components of the light olefin feed react to produce olefins, paraffins and aromatics which have a higher product value than the feed components. In addition, the feed components react with the aromatics in the reformate to produce alkyl aromatics which themselves may rearrange and transalkylate over the catalyst to produce a further range of products. U.S. Pat. No. 4,992,607 (Harandi) also describes a process for upgrading reformate using FCC fuel gas as a source of olefins for alkylation of the aromatic components present in the reformate.

U.S. Pat. No. 4,950,387 (Harandi) describes a process in which a naphtha stream is upgraded by reaction with light olefins such as FCC fuel gas. The naphtha may be a light FCC naphtha, a heavy FCC naphtha or a heart cut of heavy naphtha drawn from the FCC column.

In all cases where a reformate is treated in these processes, the benzene content is reduced during the process by the alkylation reactions over the catalyst. It would, however, be desirable to reduce the benzene levels still further.

SUMMARY OF THE INVENTION

We have now devised a process for upgrading low octane naphthas to produce gasoline products with low levels of benzene while retaining a reasonably high pool octane. The present processing scheme uses a naphtha reformer feed which is dehexanized to provide a $C_7+$ reformer fraction which is fed to the reformer and a $C_6$ fraction which is fed together with the $C_6$ fraction from the reformer effluent to a catalytic upgrading step. In this upgrading step, the low octane components from the naphtha and the benzene from the reformate are converted to light gas and a low benzene, high octane gasoline by alkylation of the benzene and other aromatics which are present, either from the naphtha or from the reformate. The process has the advantage that benzene make in the reformer is reduced by the by-passing of the $C_6$ benzene precursors around the reformer; in addition, improved benzene alkylation results from the presence of additional light olefins generated by the cracking of paraffins and naphthenes from the naphtha in the upgrading reaction zone.

The alkylation of the benzene is preferably carried out with added olefins from an external source but the olefins may in favorable circumstances be produced in the upgrading step itself by cracking of the naphtha feed. The olefins may themselves be converted to gasoline boiling range materials.

DRAWINGS

The single FIGURE of the accompanying drawings is a simplified process schematic showing one form of the present upgrading process

DETAILED DESCRIPTION

Process Configuration

In the present process a feedstream containing benzene and $C_6$ paraffins and naphthenes is upgraded in the presence of a zeolite catalyst such as ZSM-5 to produce a gasoline boiling range product which is low in benzene and other aromatics but has a good pool octane rating. In addition, the upgrading process reduces RVP and may be used to reduce product sulfur levels if desulfurization has not been carried out in another step.

The FIGURE is a simplified process schematic for carrying out the present upgrading. A naphtha feedstream, suitably of light straight run (LSR) naphtha enters the unit through line 10 and passes into a fractionator 11 operating as a dehexanizer. The $C_7+$ bottoms fraction which typically contains less than 5 weight percent $C_6$ components is removed through line 12 and passes to reformer 13 in which the typical reforming reactions take place to produce a reformate containing benzene in effluent line 14. The reformate from line 14 passes into a second dehexanizer 15 which separates the reformate into a heavy $C_7+$ reformate fraction which passes out of the unit through line 16 and into the gasoline pool or to other utilization and a $C_6-$ fraction which is sent to dehexanizer 11 through line 17, entering dehexanizer 11 at a level appropriate to its composition.

Dehexanizer 11 separates a $C_6$ fraction withdrawn as sidedraw in line 20; this fraction contains paraffinic and naphthenic components from the LSR feed together with benzene from the reformer. The benzene make in the reformer is, however, limited by the bypassing which occurs as a result of withdrawing $C_6$ naphtha components through the sidedraw. The sidedraw is passed to upgrading reactor 21 in which it is reacted in a single pass reaction (no recycle) with external olefins entering through line 22. The product comprising a high octane low benzene gasoline is taken out through line 23 to the refinery gasoline pool for blending with a $C_5$-$C_6$ rich gasoline withdrawn from dehexanizer 11 through line 24 and other pool gasoline components such as the heavy reformate from line 16, alkylate and straight run naphthas.

Recycle of the upgraded product may be achieved, if desired, by passing a proportion of the low benzene gasoline from line 23 through recycle line 25 to dehexanizer 15 to permit the $C_7$+ portion of the product to be removed with the bottoms through line 16 and the unconverted $C_6$ fraction to be returned to the upgrading reactor through line 17, dehexanizer 11 and line 20.

Hydrocarbon Feeds

The initial naphtha feed comprises a naphtha which is relatively rich in $C_6$ components including paraffins and naphthenes, such as cyclohexane and methyl cyclopentane, and is suitable for use as a reformer feed. Light straight run naphthas boiling from $C_5$ to about 400° F. (about 205° C.), usually up to about 380° F. (about 195° C.) are suitable for this purpose. Straight run stocks are normally preferred as suitable feeds for the reformer but cracked stocks including catalytically cracked gasolines, e.g. FCC naphthas may also be employed.

The naphtha may be pretreated to remove sulfur so that no separate pre-treatment is required after passing through the dehexanizer; sulfur may be reduced to levels appropriate for the reformer, typically to below 10 ppmw. Alternatively, the bottoms from dehexanizer 11 may be hydrotreated in pretreater 25 before entering the reformer. This achieves an economy in hydrogen consumption although at the cost of added complication. As described below, the upgrading reactor itself may be used to convert organic sulfur and nitrogen compounds from the $C_6$ components routed into reactor 21 without the addition of hydrogen. In this case, only the reformer feed requires hydrotreating so it may be possible to reduce the size of the pretreater as well as to reduce hydrogen consumption.

A major proportion of the low octane $C_6$ components from the naphtha feed are preferably sent to the upgrading reactor. Usually, at least 75 weight percent of these materials should be sent to the upgrading reactor in order to achieve the greatest octane boost, coupled with the benzene reduction accruing from the by-passing of the reformer. These low octane components are converted in the upgrading reactor to light gas and a low benzene, high octane gasoline. the conversion of these components is typically from 20 to 80 percent per pass, depending on the operating severity and the supply of external olefins. Benzene conversion in the upgrading reactor is usually in the same range but normally will not exceed about 65 percent per pass due to the limited availability of light olefins and competing olefin-olefin reactions but in favorable circumstances, conversion may be higher. Benzene conversions in the range of 40 to 60 percent are typical; depending on the level of benzene reduction required, benzene conversions in the range of 40 to 50 percent may be adequate in many cases.

The olefins may be supplied from an external source, as described in U.S. Pat. Nos. 4,827,069 and 4,992,607. Suitable olefins for use in the present process include ethylene and propylene from FCC light (fuel) gas as well as higher olefins such as butene and pentene. Sources of such olefins include FCC fuel gas, as mentioned, propylene and butene from the FCC USGP and pentene from light FCC naphtha. Other hydrocarbons may be mixed with the olefin feedstream, particularly paraffins in FCC fuel gas which may typically contain up to about 40 weight percent olefins, usually 10 to 40 mol percent $C_2$-$C_3$ olefins with 5 to 35 mol percent hydrogen with varying amounts of $C_1$-$C_3$ paraffins and inert gases such as nitrogen. Light FCC naphtha is also a source of higher olefins, typically $C_6$-$C_8$ olefins, which may be used as an olefin co-feed in line 22; light FCC naphtha also provides a source of benzene and other aromatics which are converted in the present upgrading process together with the aromatics from the reformer and those from the LSR feed. As described in application Ser. No. 08/028,054, filed March 8, 1993, now abandoned (Case 6996), the use of $C_5$+olefins from sources such as FCC naphtha and pyrolysis gasoline results in a product which remains in the gasoline boiling range, i.e. is substantially all $C_5$-$C_{10}$, notwithstanding the reactions which take place between the benzene and the $C_5$ olefins in the co-feed.

The olefins may also be produced in situ by cracking of the paraffins and naphthenes in the $C_6$ fraction of the naphtha. These cracking reactions take place along with the alkylation reactions in the presence of the acidic catalyst in the upgrading reactor. In this case, no external olefins are necessary so that the sole feed to the upgrading reactor may comprise the sidedraw from the dehexanizer comprising $C_6$ components from the naphtha and the reformate. The cracking reactions may in any event supply additional olefins when an olefinic co-feed is used.

The $C_5$− olefins, undergo reactions such as those described in U.S. Pat. No. 4,827,069 for conversion to gasoline boiling range materials. Such reactions include olefin-olefin reactions which result in $C_5$ to $C_9$ olefinic, $C_5$ to $C_9$ paraffinic and $C_6$ to $C_8$ gasoline components as well as alkylation reactions with $C_6$ to $C_8$ aromatics, especially benzene, to produce primarily $C_7$ to $C_{11}$ aromatics which may themselves rearrange and transalkyate over the catalyst in the upgrading reactor. The $C_7$ to $C_{11}$ aromatic hydrocarbons obtaine din this way include lower alkyl ($C_1$ to $C_4$) substituted aromatics such as methyl, ethyl, propyl and butyl substituted benzenes and dialkyl benzenes where the total carbons in the alkyl substituents does not exceed 5. Examples of such alkylation products include toluene, xylenes, ethylbenzene, methyl ethyl benzene, propyl benzene, methyl propyl benzene, butyl benzene, methyl butyl benzene and diethyl benzene. The incorporation of the side chain(s) into the original aronmatic hydrocarbons improves the overall octane quality of the gasoline product as well as lowering its RVP.

The effluent from the reformer will comprise benzene as well as other aromatics, unreacted paraffins and cycloparaffins. The aromatics in the reformate will principally be in the $C_6$-$C_9$ range, principally benzene, toluene, xylenes and ethylbenzene, with the ratio between the various aromatics being dependent on the character of the reformer feed and reforming conditions. The paraffins in the reformate will typically be in the $C_5$–$C_9$ range. Separation of the reformate in the dehexanizer downstream of the reformer passes at least 75 and preferably at least 80 percent of the benzene produced in the reformer to the upgrading reactor together with similar boiling range paraffins and cycloparaffins which have not been converted in the reformer. When recycle is provided, the feed to the upgrading reactor will, of course, include recycled components in the appropriate boiling range.

Upgrading Reactions

A number of reactions take place in the upgrading reactor between the hydrocarbons which are present. These reactions, which may take place sequentially and simultaneously include:

| | | |
|---|---|---|
| Feed Olefins | → | Equilibrated Olefin Mixture |
| Olefin Mixture | → | Aromatics + Paraffins |
| Benzene + Feed Olefins | → | Alkylaromatics |
| Benzene + Equilibrated Olefins | → | Alkylaromatics |
| Paraffins | → | $C_3$-$C_4$ Paraffins + Olefins |
| Naphthenes | → | Aromatics, Paraffins, Olefins |

The conversion of benzene to alkyl aromatics is accompanied by both octane uplifts and gasoline yield increase resulting from the incorporation of light olefins into the product. Other reactions also occur along with benzene alkylation and alkylaromatic isomerization, including olefin oligomerization, olefin redistribution and equilibration, cyclization, and aromatization and hydrogen transfer. Under appropriate conditions, paraffin cracking is also observed, producing olefins for reaction with the aromatics in the feed or those produced from the reactions set out above. The cyclics in the naphtha feed undergo both cracking and aromatization reactions with a relatively low selectivity to benzene. The heart cut from the reformate is also rich in $C_6$ paraffins and these components will also readily crack. These cracking reactions generate light olefins which are upgraded to higher octane products by the reactions set out above.

The benefits accruing from the use of the naphtha and reformate heart cut co-feeds include:

1. conversion of low octane gasoline to higher octane gasoline without significant formation of benzene, as would take place in the reformer.
2. Improved benzene alkylation from the the additional light olefins generated from cracking the reformer feed.

The upgrading reactions are carried out in the presence of a solid, particulate catalyst of acidic functionality such as the preferred ZSM-5 based catalysts. The process is preferably operated in a dense phase, turbulent, fluidized bed as described in U.S. Pat. No. 4,827,069 to which reference is made for a detailed description of the operating parameters, including details of the fluidization regimes. This mode of operation is preferred becausse better mixing is achieved together with extended contact times. Alternatively, the process may be carried out in a riser reactor as described in U.S. Pat. No. 4,992,607, to which reference is made for a detailed description of this mode of operation.

In general terms, the upgrading is typically carried out in the dense phase, turbulent reactor at a temperature in the range of 500° to 900° F. (about 260° to about 480° C.), more usually from 600° to 850° F. (about 315° to 455° C). Low to moderate pressure are suitable, typically from about 50 to 500 psig, total system pressure, reactor inlet (about 445 to 3550 kPaa), preferably about 100 to 400 psig (about 790 to 2860 kPaa). In contrast to the conditions described in U.S. Pat. 4,827,069, however, it is not necessarily preferred that cracking of the $C_3$ to $C_6$ paraffins should be minimized since, as described above, the cracking of these components may provide addtional olefins for reaction with the benzene. For this reason, temperatures higher than those described in U.S. Pat. 4,827,069 may be preferred, particularly when no olefin co-feed is used. Total hydrocarbon space velocity (fluid bed operation) will typically be in the range of about 0.5 to about 5 WHSV, more normally from about 0.5 to 2.0 WHSV. Catalyst regeneration may be carried out as described in U.S. Pat. No. 4,827,069, that is, by circulating the catalyst from the reaction zone to the regenerator in which it is regenerated by contact with air, hydrogen or other regenerating gas.

The ratio of the olefin co-feed to the $C_6$ fraction being fed to the upgrading reactor is typically from about 0:1 to 10:1 (by weight) and preferably 0.2:1 to 5:1, usually about 1:1 (stream 22: stream 20). The amount of olefin fed to the upgrading reactor should be sufficient to achieve the desired benzene conversion. Ethylene is more reactive with benzene than propylene so that olefin conversion will depend upon the composition of the olefin feed; benzene conversion will similarly vary according to olefin feed composition for the same reason. The use of high olefin:aromatic ratios is desirable in order to maximize benzene alkylation.

When operating with a riser type reactor as described in U.S. Pat. No. 4,992,607, the conditions will be as described there, namely with a temperature in the riser section of the reactor from 350° to 900° F. (about 175° to about 480° C.), usually 500° to 850° F. (about 2600° to about 455° C). Pressure in the riser section of the reactor will typically be in the range of 20 to 650 psig (about 240 to 4580 kPaa), usually from about 50 to 420 psig (about 445 to 3000 kPaa). The weight ratio of catalyst to hydrocarbon feed will typicaly be from 0.5:1 to 50:1, more usually from 1:1 to 10:1, and in most cases, from 3:1 to 7:1, by weight. The other conditions appropriate for operation of the riser type reactor and the regenerator are described in detail in U.S. Pat. No. 4,992,607, to which reference is made for such as detailed description. As noted in U.S. Pat. No. 4,992,607, the olefin co-feed to the reactor may be injected at a number of spaced points along the length of the riser.

The catalytic reformer is operated under conditions appropriate to the type of unit in use (fixed bed or continuous catalytic reforming) as well as to the feed requirements and the operating severity required. These conditions are conventional and can be adequately selected by those skilled in the art.

The products from the reaction include a major proportion in the gasoline boiling range, typically $C_5$ to about 400° F. (about 205° C.), although higher end points may be encountered depending on the reaction conditions in the upgrading reactor. When FCC light naphtha is used as a source of olefins, higher alkylation products may be formed, although most are in the range $C_5$—$C_{10}$, as described in application Ser. No. 08/028,058, filed March 8, 1993, now abandoned (Mobile Case 6996). Normally, not more than about 10 weight percent of the liquid $C_5$ product will be $C_{11}+$ hydrocarbons.

The upgrading may be accompanied by desulfurization of sulfur-containing feed components, as described in application Ser. No. 08/028,058, filed March 8, 1993, now abandoned. This desulfurization proceeds in the absence of added hydrogen and therefore provides an additional route to reducing gasoline product sulfur levels, with the added advantage of reducing process hydrogen requirements. Reference is made to Serial No. 08/028,058, filed March 8, 1993, now abandoned, for a detailed description of the desulfurization process and of the product sulfur levels which may be achieved in this way.

Upgrading Catalysts

The acidic catalyst used in the upgrading reaction is preferably a zeolite-based catalyst, that is, it comprises an acidic zeolite in combination with a binder or matrix material such as alumina. silica, or silica-alumina. The preferred zeolites for use in the catalysts in the present process are the medium pore size zeolites, especially those having the structures of ZSM-5, ZSM-11, ZSM-22, ZSM-23, ZSM-35, ZSM-48 or MCM-22. The medium pore size zeolites are a well-recognized class of zeolites and can be characterized as having a constraint Index of 2 to 12 (Constraint Index is determined as described in U.S. Pat. 4,016,218). Catalysts of this type are described in U.S. Pat. Nos. 4,827,069 and 4,992,067, to which reference is made for further details of such catalysts, zeolites and binder or matrix materials.

The present process may also use catalysts based on large pore size zeolites such as the synthetic faujasites, especially zeolite Y, preferably in the form of zeolite USY. Zeolite beta may also be used as the zeolite component. Other materials of acidic functionality which may be used in the catalyst include the materials identified as MCM-36 (described in U.S. patent applications Ser. Nos. 07/811,360, filed 20 Dec. 1991 and 07/878,277, filed 4 May 1992) and MCM-49 (described in U.S. patent applications Ser. Nos. 07/802,938 filed 6 Dec. 1991 and 07/987,850, filed 9 Dec. 1992.

The acidity desired in the catalyst is suitably measured by the alpha value of the catalyst. The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 sec $_{-1}$). The alpha test is described in U.S. Pat. No. 3,354,078 and in *J. Catalysis,* 4,527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in *J. Catalysis,* 61, 395 (1980). The alpha of the catalysts used in the present process need not be more than 100 and in most cases is preferably not more than 50. For operational reasons, catalyst alpha values should preferably be in the range of 5 to 10.

The particle size of the catalyst should, of course, be selected in accordance with the fluidization regime which is used in the process. Particle size distribution will be important for maintaining turbulent fluid bed conditions as described in U.S. Pat. No. 4,827,069. Suitable particle sizes and distributions for operation of dense fluid bed and transport bed reaction zones are described in U.S. Pat. No. 4,827,069 and 4,992,607. Particle sizes in both cases will normally be in the range of 10 to 300 microns, typically from 20 to 100 microns.

EXAMPLE 1

This Example illustrates the potential for obtaining high conversion levels of paraffins, naphthenes and benzenes.

A feedstream comprising a thermally cracked naphtha having the composition set out in Table 1 below was fed into a laboratory scale dense fluid bed reactor containing a fluidisable ZSM-5 catalyst with an alpha in the range of 5 to 7. The reaction was operated at 800° F. (about 425° C.), 190 psig, total system pressure (about 1411 kPaa) and at a total hydrocarbon space velocity of 1.0 WHSV. The total hydrocarbon feed composition and the compositions of the products at two mass balances are shown in Table 1.

TABLE 1

Temp = 800° F., Reactor Pressure = 190 psig, Total HC WHSV = 1.0

| | Feed | 1 | 2 |
|---|---|---|---|
| Material Balance Number | | | |
| Hours on Stream | — | 3.3 | 8.3 |
| Total Balance Closure, % | — | 98.4 | 101.1 |
| Benzene Conversion, % | — | 45.8 | 42.0 |
| N-Hexane Conversion, % | — | 71.4 | 64.7 |
| $C_6$ Naphthene Conversion, % | — | 70.4 | 66.0 |
| Composition, wt % of Hydrocarbon | | | |
| Hydrogen | 0.00 | 0.15 | 0.03 |
| Methane | 0.00 | 0.44 | 0.42 |
| Ethane | 0.00 | 1.17 | 1.16 |
| Ethene | 0.00 | 0.20 | 0.26 |
| Propane | 0.00 | 10.57 | 9.57 |
| Propene | 0.00 | 0.57 | 0.81 |
| N-Butane | 0.00 | 3.99 | 3.76 |
| Isobutane | 0.00 | 3.92 | 3.49 |
| Butenes | 0.01 | 1.08 | 1.31 |
| Total $C_5+$ | 99.99 | 77.90 | 79.19 |
| $C_5$ P + O + N | 3.65 | 3.99 | 3.86 |
| N-Pentane | 0.41 | 1.15 | 1.18 |
| Isopentane | 0.15 | 1.82 | 1.54 |
| Pentenes | 2.64 | 0.83 | 0.92 |
| Cyclopentane | 0.44 | 0.19 | 0.23 |
| $C_6$ P + O + N | 43.41 | 17.31 | 20.17 |
| N-Hexane | 18.08 | 5.18 | 6.39 |
| Isohexanes | 17.38 | 10.29 | 11.70 |
| 2-Methylpentane | 7.14 | 3.88 | 4.46 |
| 3-Methylpentane | 8.77 | 5.28 | 6.03 |
| 2,2-Dimethylbutane | 0.33 | 0.24 | 0.27 |
| 2,3-Dimethylbutane | 1.14 | 0.89 | 0.95 |
| Hexanes | 4.12 | 0.71 | 0.79 |
| Methylcyclopentane | 3.41 | 1.05 | 1.20 |
| Cyclohexane | 0.41 | 0.08 | 0.10 |
| $C_7$ P + O + N | 14.35 | 7.01 | 7.78 |
| N-Heptane | 2.32 | 0.64 | 0.75 |
| Isoheptanes | 9.88 | 5.81 | 6.45 |
| Heptenes | 1.90 | 0.31 | 0.34 |
| $C_7$ Naphthenes | 0.25 | 0.25 | 0.24 |
| $C_8$ P + O + N | 6.61 | 5.52 | 5.68 |
| $C_9$ P + O + N | 0.79 | 0.33 | 0.25 |
| $C_{10}$ P + O + N | 0.33 | 0.06 | 0.05 |
| Benzene | 23.45 | 12.71 | 13.61 |
| Toluene | 3.10 | 6.83 | 6.24 |
| Ethylbenzene | 0.20 | 5.81 | 5.99 |
| Xylenes | 0.49 | 4.15 | 3.47 |
| $C_9$ Aromatics | 0.68 | 5.75 | 5.18 |
| Trimethylbenzenes | 0.46 | 0.94 | 0.57 |
| Methylethylbenzenes | 0.14 | 2.15 | 1.79 |
| N-Propylbenzene | 0.05 | 1.63 | 1.79 |
| Isopropylbenzene | 0.01 | 1.03 | 1.05 |
| $C_{10+}$ Aromatics | 0.56 | 2.34 | 1.92 |
| $C_{11}$ Unknowns | 2.36 | 6.09 | 4.99 |
| $C_5$ Properties | | | |
| R + O/M + O | 80.5/74.6 | 95.6/85.5 | 93.3/85.1 |
| Molecular Weight | 88.2 | 95.7 | 94.3 |
| Density @ 60_F, g/ml | 0.73 | 0.77 | 0.76 |

TABLE 1-continued

| | | | |
|---|---|---|---|
| RVP, psi | 4.8 | 4.1 | 4.2 |

EXAMPLES 2–3

These Examples illustrate the process using a light olefin co-feed (ethylene, propylene) in combination with the naphtha feed. The processing was carried out in the manner described in Example 1 but at 800° F. (about 425° C.), 190 psig (about 141 kPaa) and at a WHSV of 0.74 (total HC), 0.08 (olefin) and 0.70 overall (6.2 wt. percent $N_2$). The results are given in Tables 2 and 3 below.

TABLE 2

Example 2

Temp = 800° F. WHSV: Total HC = 0.74
Press = 190 psig Olefin = 0.08
TOS = 4 hrs Overall (6.2 wt % $N_2$) = 0.79

| | Feed | Product | Conversion |
|---|---|---|---|
| | Composition, HC wt % | | |
| Hydrogen | 0 | 0.1 | |
| Methane | 0 | 0.4 | |
| Ethane | 0 | 0.7 | |
| Ethene | 0.9 | 0.2 | 83 |
| Propane | 0 | 10.7 | |
| Propene | 5.0 | 0.5 | 90 |
| N-butane | 0 | 3.9 | |
| I-butane | 0 | 4.6 | |
| Butenes | 0 | 0.8 | |
| Total C5+ | 94.1 | 78.3 | 83.2 wt % (77.8 vol %) |
| $C_5$ PON | 2.1 | 3.5 | |
| N-pentane | 0.2 | 1.0 | |
| I-pentane | 0.1 | 1.9 | |
| Pentenes | 1.8 | 0.6 | |
| Cyclopentane | 0 | 0 | |
| $C_6$ PON | 44.9 | 21.8 | |
| N-hexane | 10.5 | 2.6 | 75 |
| Methyl pentane | 19.2 | 10.0 | 48 |
| Dimethylbutane | 10.5 | 8.2 | 22 |
| $C_6$ olefins | 2.5 | 0.4 | |
| $C_6$ naphthenes | 2.2 | 0.7 | 69 |
| $C_7$ PON | 7.8 | 3.7 | |
| N-heptane | 1.4 | 0.3 | 78 |
| $MeC_6 + EtC_5$ | 3.7 | 1.7 | 55 |
| Dimethylpentanes | 1.6 | 1.3 | 16 |
| $C_7$ olefins | 1.0 | 0.2 | |
| $C_7$ naphthenes | 0.2 | 0.2 | 0 |
| $C_8$ PON | 2.6 | 2.1 | |
| $NC_8$ paraffins | 0.1 | 0 | |
| $IC_8$ paraffins | 2.2 | 2.0 | |
| $C_8$ olefins | 0.1 | 0 | |
| $C_8$ naphthenes | 0.2 | 0.1 | |
| $C_9$ PON | 0.3 | 0.1 | |
| $C_{10}$ PON | 0 | 0 | |
| Total Aromatics | 36.3 | 47.1 | |
| Benzene | 33.2 | 19.4 | 42 |
| Toluene | 2.0 | 6.0 | |
| Ethylbenzene | 0.2 | 7.4 | |
| Xylenes | 0.3 | 2.8 | |
| $C_9$ Aromatics | 0.3 | 5.7 | |
| $C_{10}$+ Aromatics | 0.4 | 5.9 | |
| | C5+ Properties | | |
| RON + O | 86.9 | 99.9 | Δ = 13 |
| MON + O | 79.3 | 87.7 | Δ = 8 |
| SG @ 60 F | 0.741 | 0.794 | |
| MW | 84.6 | 91.6 | |
| RVP, psia | 5.23 | 4.61 | Δ = −0.62 |
| MB HC Closure, wt % | — | 98.8 | |

TABLE 3

Example 3

Temp = 800° F. WHSV: Total HC = 0.74
Press = 190 psig Olefin = 0.08
TOS = 4 hrs Overall (6.2 wt % $N_2$) = 0.79

TABLE 3-continued

Example 3

| | Feed | Product | Conversion |
|---|---|---|---|
| | Composition, HC wt % | | |
| Hydrogen | 0 | 0.1 | |
| Methane | 0 | 0.4 | |
| Ethane | 0 | 0.8 | |
| Ethene | 0.9 | 0.2 | 79 |
| Propane | 0 | 9.6 | |
| Propene | 4.6 | 0.6 | 86 |
| N-butane | 0 | 3.5 | |
| I-butane | 0 | 3.8 | |
| Butenes | 0 | 1.0 | |
| Total C5+ | 94.5 | 80.0 | 84.6 wt % (79.5 vol %) |
| $C_5$ PON | 2.2 | 3.3 | |
| N-pentane | 0.3 | 0.9 | |
| I-pentane | 0.1 | 1.6 | |
| Pentenes | 1.8 | 0.8 | |
| Cyclopentane | 0 | 0 | |
| $C_6$ PON | 45.1 | 23.8 | |
| N-hexane | 10.5 | 3.2 | 69 |
| Methyl pentane | 19.3 | 10.9 | 43 |
| Dimethylbutane | 10.5 | 8.5 | 19 |
| $C_6$ olefins | 2.5 | 0.4 | |
| $C_6$ naphthenes | 2.2 | 0.8 | 64 |
| $C_7$ PON | 7.9 | 3.9 | |
| N-heptane | 1.4 | 0.4 | 72 |
| $MeC_6 + EtC_5$ | 3.7 | 1.8 | 51 |
| Dimethylpentanes | 1.6 | 1.3 | 18 |
| $C_7$ olefins | 1.0 | 0.2 | |
| $C_7$ naphthenes | 0.2 | 0.2 | 0 |
| $C_8$ PON | 2.6 | 2.1 | |
| $NC_8$ paraffins | 0.1 | 0 | |
| $IC_8$ paraffins | 2.2 | 2.0 | |
| $C_8$ olefins | 0.1 | 0 | |
| $C_8$ naphthenes | 0.2 | 0.1 | |
| $C_9$ PON | 0.3 | 0.1 | |
| $C_{10}$ PON | 0 | 0 | |
| Total Aromatics | 36.5 | 46.7 | |
| Benzene | 33.3 | 20.4 | 39 |
| Toluene | 2.0 | 6.1 | |
| Ethylbenzene | 0.2 | 7.5 | |
| Xylenes | 0.3 | 2.8 | |
| $C_9$ Aromatics | 0.3 | 5.4 | |
| $C_{10}$+ Aromatics | 0.4 | 4.5 | |
| | C5+ Properties | | |
| RON + O | 86.9 | 98.8 | Δ = 12 |
| MON + O | 79.3 | 87.3 | Δ = 8 |
| SG @ 60 F | 0.741 | 0.789 | |
| MW | 84.6 | 90.7 | |
| RVP, psia | 5.23 | 4.64 | Δ = −0.59 |
| MB HC Closure, wt % | — | 100.1 | |

EXAMPLES 4–5

These two Examples were carried out as described in Examples 2–3 above but at a temperature of 750° F. (about 400° C). The results are given in Tables 4 and 5 below.

TABLE 4

Example 4

Temp = 750° F. WHSV Total HC = 0.74
Press = 190 psig Olefin = 0.08
TOS = 4 hrs Overall (6.2 wt % $N_2$) = 0.79

| | Feed | Product | Conversion |
|---|---|---|---|
| | Composition, HC wt % | | |
| Hydrogen | 0 | 0 | |
| Methane | 0 | 0.1 | |
| Ethane | 0 | 0.2 | |
| Ethene | 0.9 | 0.1 | 94 |
| Propane | 0 | 6.2 | |
| Propene | 4.4 | 0.3 | 94 |
| N-butane | 0 | 3.7 | |
| I-butane | 0 | 4.2 | |
| Butenes | 0 | 0.5 | |
| Total C5+ | 94.7 | 84.8 | 89.5 wt % |

TABLE 4-continued

| Example 4 | | | |
|---|---|---|---|
| | | | (85.3 vol %) |
| $C_5$ PON | 2.2 | 4.0 | |
| N-pentane | 0.3 | 1.5 | |
| I-pentane | 0.1 | 2.1 | |
| Pentenes | 1.8 | 0.4 | |
| Cyclopentane | 0 | 0 | |
| $C_6$ PON | 45.2 | 28.3 | |
| N-hexane | 10.5 | 2.9 | 73 |
| Methyl pentane | 19.3 | 14.0 | 28 |
| Dimethylbutane | 10.5 | 10.1 | 5 |
| Cphd 6 olefins | 2.5 | 0.4 | |
| $C_6$ naphthenes | 2.3 | 1.0 | 56 |
| $C_7$ PON | 7.9 | 4.6 | |
| N-heptane | 1.4 | 0.3 | 82 |
| $MeC_6 + EtC_5$ | 3.7 | 2.4 | 36 |
| Dimethylpentanes | 1.6 | 1.6 | 4 |
| $C_7$ olefins | 1.0 | 0.2 | |
| $C_7$ naphthenes | 0.2 | 0.2 | 0 |
| $C_8$ PON | 2.6 | 2.4 | |
| $NC_8$ paraffins | 0.1 | 0 | |
| $IC_8$ paraffins | 2.2 | 2.2 | |
| $C_8$ olefins | 0.1 | 0 | |
| $C_8$ naphthenes | 0.2 | 0.2 | |
| $C_9$ PON | 0.3 | 0.4 | |
| $C_{10}$ PON | 0 | 0 | |
| Total Aromatics | 36.5 | 45.0 | |
| Benzene | 33.4 | 22.3 | 33 |
| Toluene | 2.0 | 3.9 | |
| Ethylbenzene | 0.2 | 6.0 | |
| Xylenes | 0.3 | 1.5 | |
| $C_9$ Aromatics | 0.3 | 6.6 | |
| $C_{10}$+ Aromatics | 0.4 | 4.7 | |
| | C5+ Properties | | |
| RON + O | 86.9 | 97.3 | Δ = 10 |
| MON + O | 79.3 | 87.1 | Δ = 8 |
| SG @ 60 F | 0.741 | 0.778 | |
| MW | 84.6 | 90.1 | |
| RVP, psia | 5.23 | 4.94 | Δ = −0.29 |
| MB HC Closure, % | — | 94.6 | |

TABLE 5

| Example 5 | | | |
|---|---|---|---|
| Temp = 750° F. | | WHSV Total HC = 0.73 | |
| Press = 190 psig | | Olefin = 0.07 | |
| TOS = 10 hrs | | Overall (6.2 wt % $N_2$) = 0.78 | |
| | Feed | Product | Conversion |
| | Composition, HC wt % | | |
| Hydrogen | 0 | 0 | |
| Methane | 0 | 0.1 | |
| Ethane | 0 | 0.2 | |
| Ethene | 0.9 | 0.1 | 92 |
| Propane | 0 | 4.6 | |
| Propene | 3.7 | 0.3 | 91 |
| N-butane | 0 | 2.8 | |
| I-butane | 0 | 2.9 | |
| Butenes | 0 | 0.6 | |
| Total C5+ | 95.4 | 88.4 | 92.7 wt % (88.5 vol %) |
| $C_5$ PON | 2.2 | 3.4 | |
| N-pentane | 0.3 | 1.3 | |
| I-pentane | 0.1 | 1.6 | |
| Pentenes | 1.8 | 0.6 | |
| Cyclopentane | 0 | 0 | |
| $C_6$ PON | 45.6 | 32.3 | |
| N-hexane | 10.6 | 4.7 | 56 |
| Methyl pentane | 19.5 | 15.6 | 20 |
| Dimethylbutane | 10.6 | 10.2 | 4 |
| $C_6$ olefins | 2.6 | 0.5 | |
| $C_6$ naphthenes | 2.3 | 1.3 | 42 |
| $C_7$ PON | 7.9 | 5.3 | |
| N-heptane | 1.4 | 0.5 | 65 |
| $MeC_6 + EtC_5$ | 3.7 | 2.8 | 25 |
| Dimethylpentanes | 1.6 | 1.6 | 3 |
| $C_7$ olefins | 1.0 | 0.2 | |
| $C_7$ naphthenes | 0.2 | 0.2 | 0 |
| $C_8$ PON | 2.6 | 2.4 | |
| $NC_8$ paraffins | 0.1 | 0 | |

TABLE 5-continued

| Example 5 | | | |
|---|---|---|---|
| $IC_8$ paraffins | 2.2 | 2.3 | |
| $C_8$ olefins | 0.1 | 0 | |
| $C_8$ naphthenes | 0.2 | 0.2 | |
| $C_9$ PON | 0.3 | 0.4 | |
| $C_{10}$ PON | 0 | 0 | |
| Total Aromatics | 36.8 | 44.7 | |
| Benzene | 33.6 | 22.5 | 33 |
| Toluene | 2.0 | 3.7 | |
| Ethylbenzene | 0.2 | 5.5 | |
| Xylenes | 0.3 | 1.5 | |
| $C_9$ Aromatics | 0.3 | 7.3 | |
| $C_{10}$+ Aromatics | 0.4 | 4.2 | |
| | C5+ Properties | | |
| RON + O | 86.9 | 95.3 | Δ = 8 |
| MON + O | 79.3 | 86.1 | Δ = 7 |
| SG @ 60 F | 0.741 | 0.777 | |
| MW | 84.6 | 90.0 | |
| RVP, psia | 5.23 | 4.85 | Δ = −0.38 |
| MB HC Closure, % | — | 101.0 | |

We claim:

1. A process for upgrading a hydrocarbon naphtha feed to form a gasoline boiling range product of reduced benzene content, which comprises:

(i) fractionating the hydrocarbon naphtha to form a $C_6$ fraction and a $C_7$+ fraction, (ii) subjecting the $C_7$+ fraction to reforming to form a reformate containing aromatic compounds formed by reforming of the hydrocarbons in the $C_7$+ fraction, (iii) fractionating the reformate to form a $C_6$− fraction containing benzene, (iv) reacting the benzene with olefins in the presence of the $C_6$ fraction of the naphtha and a catalyst of acidic functionality to form alkylaromatics.

2. A process according to claim 1 in which the olefins comprise $C_5$− olefins.

3. A process according to claim 2 in which the olefins comprise ethylene, propylene or a mixture of ethylene and propylene.

4. A process according to claim 2 which includes the step of (v) feeding $C_5$− olefins to a reaction zone in which the benzene is reacted with the olefins.

5. A process according to claim 1 in which the olefins are formed by cracking of paraffinic and naphthenic hydrocarbons in the $C_6$ fraction of the naphtha in the presence of the catalyst of acidic functionality.

6. A process according to claim 1 in which the olefins comprise $C_5$+ olefins.

7. A process according to claim 6 which includes the step of feeding an olefinic naphtha to a reaction zone in which the benzene is reacted with the olefins from the $C_5$+ naphtha to supply the $C_5$+ olefins to the reaction zone.

8. A process according to claim 7 in which the olefinic naphtha comprises a catalytically cracked $C_5$+ naphtha.

9. A process according to claim 1 in which the catalyst of acidic functionality comprises a zeolite catalyst.

10. A process according to claim 9 in which the zeolite catalyst comprises an intermediate pore size zeolite catalyst.

11. A process for reducing the benzene content of a gasoline boililng range product comprising a reformate which contains benzene produced by the reforming of a paraffinic naphtha, which comprises:

(i) fractionating the reformate to form a $C_6$ fraction containing benzene from the reformate, (ii) feeding a $C_6$ naphtha fraction comprising $C_6$ paraffins and naphthenes to a reaction zone to form olefins by the cracking of paraffins and naphthenes from the naphtha fraction in the reaction zone, (iii) alkylating the benzene in the reaction zone at elevated temperature with the olefins formed by the cracking of the $C_6$ paraffins and naphthenes in the presence of a catalyst of acidic functionality, to form alkylaromatic compounds in the gasoline boiling range.

12. A process according to claim 11 in which the reaction zone is at a temperature of 500° to 900° F.

13. A process according to claim 12 in which the reaction zone is at a pressure from 50 to 500 psig.

14. A process according to claim 12 in which the reaction zone is a dense phase turbulent fluid bed reaction zone at a temperature from 600° to 850° F.

15. A process according to claim 11 in which the catalyst of acidic functionality comprises a catalyst comprising an intermediate pore size zeolite.

16. A process according to claim 15 in which the intermediate pore size zeolite is ZSM-5.

17. A process according to claim 11 in which the catalyst of acidic functionality comprises particles of a fluidizable particulate zeolite catalyst and in which the reaction is carried out under turbulent fluidized bed conditions.

18. A process according to claim 11 in which the catalyst of acidic functionality has an alpha value of 5 to 10.

19. A process according to claim 11 in which the reformate is produced by reforming a $C_7+$ fraction containing less than 5 weight percent $C_6-$ components produced by the fractionation of a paraffinic naphtha into the $C_7+$ fraction and the $C_6$ naphtha fraction.

20. A process according to claim 19 in which the reformate is produced by reforming a $C_7+$ fraction containing less than 5 weight percent $C_6-$ components produced by the fractionation of a paraffinic naphtha into the $C_7+$ fraction, the $C_6$ naphtha fraction and a $C_5$ fraction.

21. A process for upgrading a hydrocarbon naphtha reformer feed to form a gasoline boiling range product of reduced benzene content and Reid Vapor Pressure, which comprises:

(i) fractionating the hydrocarbon naphtha reformer feed to form a $C_6$ fraction and a $C_7+$ fraction, (ii) subjecting the $C_7+$ fraction to reforming to form a reformate containing aromatic compounds formed by reforming of the hydrocarbons in the $C_7+$ fraction, (iii) fractionating the reformate to form a $C_6-$ fraction containing benzene, (iv) combining the $C_6$ fraction of the naphtha reformer feed and the $C_6$ fraction of the reformate and feeding the combined fractions to a dense turbulent bed reaction zone containing a fluidized solid, particulate catalyst of acidic functionality having an alpha value from 1 to 10, (v) reacting the benzene in the $C_6-$ fraction of the reformate with olefins in the dense turbulent bed reaction zone at a temperature from 500° to 900° F. and a pressure from 50 to 500 psig, total system pressure, and at a total hydrocarbon space velocity from 0.5 to 5 WHSV, to form alkylaromatics.

22. A process according to claim 21 in which the olefins comprise added $C_5-$ olefins.

23. A process according to claim 21 in which the olefins are formed by cracking of paraffinic and naphthenic hydrocarbons in the $C_6$ fraction of the naphtha reformer feed in the presence of the catalyst of acidic functionality.

24. A process according to claim 21 in which the olefins comprise added $C_5+$ olefins.

25. A process according to claim 24 which includes the step of feeding a catalytically cracked $C_5+$ olefinic naphtha to the dense turbulaent bed reaction zone to provide $C_5+$ olefins which are reacted with the benzene in the reaction zone to form alkylaromatics.

* * * * *